United States Patent [19]

Roeber

[11] 4,035,690

[45] July 12, 1977

[54] PLASMA PANEL DISPLAY DEVICE INCLUDING SPHEROIDAL GLASS SHELLS

[75] Inventor: Frederick W. Roeber, Concord, Mass.

[73] Assignee: Raytheon Company, Lexington, Mass.

[21] Appl. No.: 518,029

[22] Filed: Oct. 25, 1974

[51] Int. Cl.[2] ..... H01J 61/30; H05B 41/00

[52] U.S. Cl. ..... 315/169 TV; 313/188; 313/201; 313/220

[58] Field of Search ..... 313/201, 435, 220, 188; 315/228, 169 R, 169 TV

[56] References Cited

U.S. PATENT DOCUMENTS

| | | | |
|---|---|---|---|
| 2,644,113 | 6/1953 | Etzkorn | 315/228 |
| 3,157,823 | 11/1964 | Clapp | 315/169 R |
| 3,317,728 | 5/1967 | Hamann | 313/485 X |
| 3,499,167 | 3/1970 | Baker et al. | 313/220 X |
| 3,602,754 | 8/1971 | Pfaender et al. | 313/201 X |
| 3,671,938 | 6/1972 | Ngo | 315/169 R X |
| 3,678,322 | 7/1972 | Souri | 313/201 |
| 3,848,248 | 12/1974 | MacIntyre, Jr. | 313/201 X |

FOREIGN PATENT DOCUMENTS

| | | |
|---|---|---|
| 7,301,688 | 8/1973 | Netherlands |

*Primary Examiner*—Palmer C. Demeo

*Attorney, Agent, or Firm*—John R. Inge; M. D. Bartlett; J. D. Pannone

[57] ABSTRACT

A plasma panel display device wherein a plasma forming gas is encapsulated in clear glass spheres which are sandwiched between two glass or plastic panels having transparent electrodes thereon. In some embodiments, the type of gas filling some of the spheres is varied to provide a multicolor display panel. A method for filling the small glass spheres with the preferred gas is also described.

10 Claims, 3 Drawing Figures

PLASMA PANEL DISPLAY DEVICE INCLUDING SPHEROIDAL GLASS SHELLS

BACKGROUND OF THE INVENTION

1. Field of the Invention

The invention relates to plasma panel display devices wherein a Nobel or other plasma forming gas is located between sets of X and Y drive electrodes. Alphanumerics and vectors are written for display by energizing selected ones of the electrodes with a writing voltage. To maintain the display once patterns have been written, a sustaining voltage is applied to all electrodes in sequence, as such panels have inherent memory capability, an erasing voltage must be applied to extinguish patterns no longer wanted. A complete description of the operations of such panels is contained in U. S. Pat. No. 3,754,230 issued Aug. 21, 1973 to Ernest P. Auger and assigned to the present assignee, the specification thereof being incorporated herein by reference. Such panels are employed in a variety of applications requiring a flat display device.

2. Description of the Prior Art

Numerous types of plasma panel display devices have been constructed with a variety of methods for enclosing a plasma forming gas between sets of X and Y drive electrodes. In the most popular type of prior art plasma display panel, parallel plates of glass with wire electrodes on the surfaces thereof were spaced uniformly apart and sealed together at the outer edges with the plasma forming gas filling the cavity thereby formed. In some such panels, the metal electrodes were coated with a thin layer of glass. To maintain uniform brightness over the surface of the panel and to provide a panel with writing and substaining voltages constant throughout the panel within predetermined limits extremely fine tolerances on the spacing between plates had to be maintained. If the metal electrodes were not coated with glass the plasma forming gas would slowly react with metal eventually rendering the panel inoperative. If the metal electrodes were coated with glass to prevent reaction between the gas and the metal, high voltages had to be used to overcome the separation between electrode and gas provided by the glass. These problems as well as others combined to make fabrication of such panels time consuming, difficult to produce with automatic processes, and consequently expensive. Moreover problems in maintaining tolerances between the parallel plates limited the size of the display panels to fairly small sizes, typically no more then 12 X 12. None of these panels have the inherent capability for producing displays with a plurality of colors and none have been successfully made mechanically flexible.

Later attempts at constructing practical plasma display devices included those in which the plasma forming gas was contained in small cells or chambers in an insulating layer sandwiched between the two parellel plates containing the electrodes. Many different geometrical configurations were attempted including cylindrical and rectangular chambers. Some of these also contained the glass in long thin capillary tubes sealed between the parallel plates. All of these devices suffered from the inherent problem of misalignment between electrodes and gas chambers. In many of these, the problem of maintaining tight tolerances between the outer parallel plates still remained as the tolerance had to be imposed upon the insulating layer containing the chambers or cells for the gas. Slight differences in spacing between intersecting electrodes causes a corresponding change in the writing and sustaining voltages for the cell formed at the intersection of the electrodes. If extremely tight tolerances between parallel plates containing the electrodes is not maintained, the sustaining voltage required for cells in one portion of the panel may exceed the writing voltage for cells in other portions of the panel. Driving circuitry which produces only a single level of writing voltage and a signal level of sustaining voltage as specified for cells in the first portion of the panel would light all the cells in the second portion of the panel during normal sustain operations. Such panels are useless for all practical applications.

SUMMARY OF THE INVENTION

Accordingly, it is an object of the present invention to provide a plasma panel display device wherein tight tolerances do not have to be maintained between electrode bearing parallel plates.

Also, it is an object of the present invention to provide a plasma panel display device wherein the plasma forming gas is not in direct contact with the energizing electrodes. Plasma forming gas as used herein includes those substances such as mercury which gasify only when properly excited.

Moreover, it is an object of the present invention to provide a plasma panel display device wherein only a single set of writing and substaining voltages need be provided.

Furthermore, it is an object of the present invention to provide a large screen plasma panel display.

Also, it is an object of the present invention to provide a plasma panel display device capable of displaying data in a plurality of colors.

Moreover, it is an object of the present invention to provide a mechanically flexible plasma panel device.

These as well as other objects of the present invention are met by the combination of means for producing an electric field at a plurality of matrix locations and a plurality of means for encapsulating a plasma forming gas disposed in the electric field so created. The electric field at the plurality of matrix location may be produced by first and second sets of spaced conductors or electrodes.

Objects of the invention are also met by a plasma panel display device having plasma forming gas contained in small transparent glass capsules or spheres formed of a closed glass shell. The spheres are manufactured and filled with the gas independent of the manufacture of the electrodes and electrode bearing parallel plates. The gas filled glass spheres are tightly bunched and randomly distributed throughout a single layer and sandwiched between the two parallel plates. An adhesive filter may be used to attach the layer of glass spheres to one of the plates in some embodiments. Flexible plastic or glass parallel plates may be used.

Plasma gas containing glass spheres for use with plasma panels in accordance with the present invention may be produced by first preselecting hollow glass spheres having preferred inner and outer dimensions. The selected spheres are heated to a temperature less than the melting temperature of glass, preferably 400° F–1500° F. A vacuum is then pulled around the spheres causing air or other unwanted gas inside the spheres to be removed through pores created when the glass is heated. A mixture of neon and nitrogen or other plasma forming gas is then introduced at a preselected pressure. The spheres are then cooled closing the pores and encapsulating the gas inside.

The invention also contemplates plasma panel display devices capable of displaying alphanumerics, vectors, and other patterns using two or more different colors. For each color to be displayed a gas is selected that produces a plasma discharge producing light of the required wavelength. Spheres encapsulating each of the gases are distributed between the parallel plates in predetermined geometric configurations. In the preferred embodiment, spheres containing the various gases are alternated row by row or column by column. Other configurations can be used such as providing one of either the row or column electrodes for each color on one plate opposed by a single electrode on the other plate with one or more spheres containing gas of each color under each of the plural electrodes.

DESCRIPTION OF THE PREFERRED EMBODIMENTS

Figure 1:
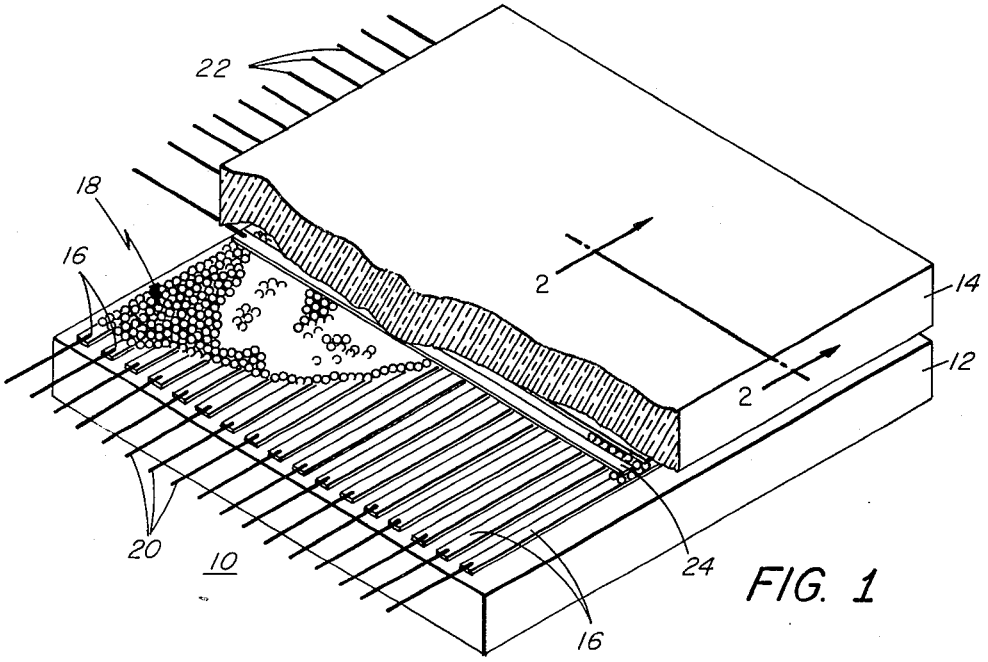
FIG. 1 is a partially cut away perspective view of a plasma display panel device in accordance with the present invention.
Figure 2:
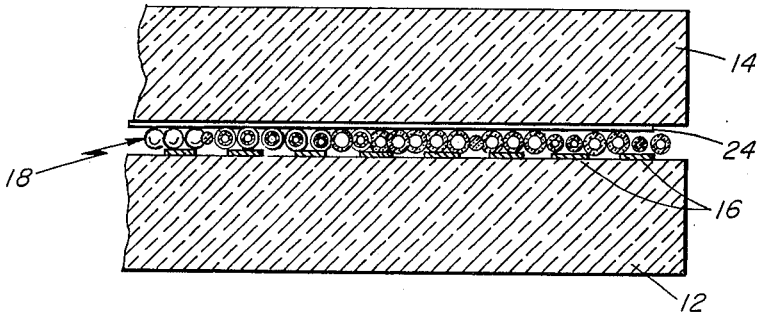
FIG. 2 is an enlarged cross-sectional view of a portion of the device shown in FIG. 1.

Referring now to FIGS. 1 and 2 there is shown generally at 10 a plasma display panel device constructed in accordance with the teachings of the present invention. Two parallel plates or panels 12 and 14 form the outer surfaces of the device. Plates 12 and 14 are transparent and preferably formed of either glass or clear plastic. The plastic may be made mechanically flexible. On the surface of each plate is arrayed parallel sets of tranparent electrodes 16 and 24. Electrodes sets 16 and 24 cross each other at right angles forming the rows and colums of a matrix. Connecting sets of leads 20 and 22 are electrically coupled to electrodes 16 and 24 respectively.

The resolution capabilities of the plasma display device are determined by the density of electrodes 16 and 22. The more of each of the electrodes used the smaller the size of and the higher the precision of the alphanumeric characters and patterns displayed. A density of 60 lines per inch has been found attainable and satisfactory for displaying small well-readable characters.

Between transparent plates 12 and 14 are sandwiched many small glass spheres 18 containing therein a gas capable of producing a plasma discharge upon excitation by application of an electric field. The spheres form a single layer between plates 12 and 14 and are randomly distributed therebetween. The spheres have a preferred outer diameter in the range of 10 to 200 microns with a thickness of approximately 2 microns. Clear glass is the preferred material although a number of other plastic compositions will also perform adequately. To produce a reddish-orange color a mixture of neon and nitrogen gas may be used with a pressure of approximately 140 mm Hg. Other gases may be used as well depending upon the color of light to be emitted.

To produce a multicolor plasma display panel, spheres are filled with each of the gases chosen to produce the desired colors. Spheres containing gas of each color are grouped among alternate ones of the transparent electrodes. For example, in a three color system, neon, mercury mixed with argon in yellow glass spheres, and mercury mixed with argon and neon will produce the colors red, green, and blue respectively. Clear glass spheres containing neon gas are located adjacent the first, fourth, and every succeeding third row electrode. Yellow glass spheres containing mercury mixed with argon are located adjacent the second, fifth, and succeeding every third electrode, and clear glass spheres containing mercury mixed with argon and neon are located adjacent the third, sixth and every further succeeding third row electrode. Excitation of the desired colors is accomplished by excitation of the row electrodes adjacent the spheres containing the gas emitting light of the desired color. Alternatively, the striped patterns may run adjacent the column rather than row electrodes. Other geometrical configurations may be used as well.

The drive characteristics for plasma display panels including the required waveforms for writing and sustaining voltages are described in the above referenced patent. The voltage level of the writing, sustaining, and erasing waveforms is dependent upon the thickness of the glass used in the gas containing glass spheres and the type of gas employed. The thicker the glass used the higher the absolute required voltage levels. The driving circuitry disclosed and claimed in the referenced patent may also be used to advantage with plasma displays panels constructed in accordance with the present invention.

Spheres encapsulating plasma forming gases for use in plasma panel devices in accordance with the present invention may be produced by preselecting glass spheres within the preferred limits of inner and outer diameters. The selected spheres are heated to a sufficient temperature to open pores in the glass but not so high as to cause the spheres to collapse. A temperature between 400° F and 1500° F has been found satisfactory for ordinary glass. A vacuum is then drawn around the spheres which removes air or other unwanted gas from inside the spheres. The selected plasma forming gas is then introduced while the elevated temperature is maintained. A pressure of 140 mm Hg has been found satisfactory. The temperature is then lowered to room temperature to close the pores and seal the plasma forming gas inside the spheres.

Improved electrical performance of the plasma panel may be had by flattening the glass spheres with the flattened surface adjacent the electrodes. Such flattening increases the capacitance formed between the electrodes and plasma forming gas and hence the amount of charge stored between writing and sustaining cycles. Immunity to unwanted firing and extinction of cross point cells is thereby increased. Flattening may be accomplished by heating the assembled panel until the glass spheres become soft then applying external pressure until the desired amount of flattening has been attained.

Figure 3:
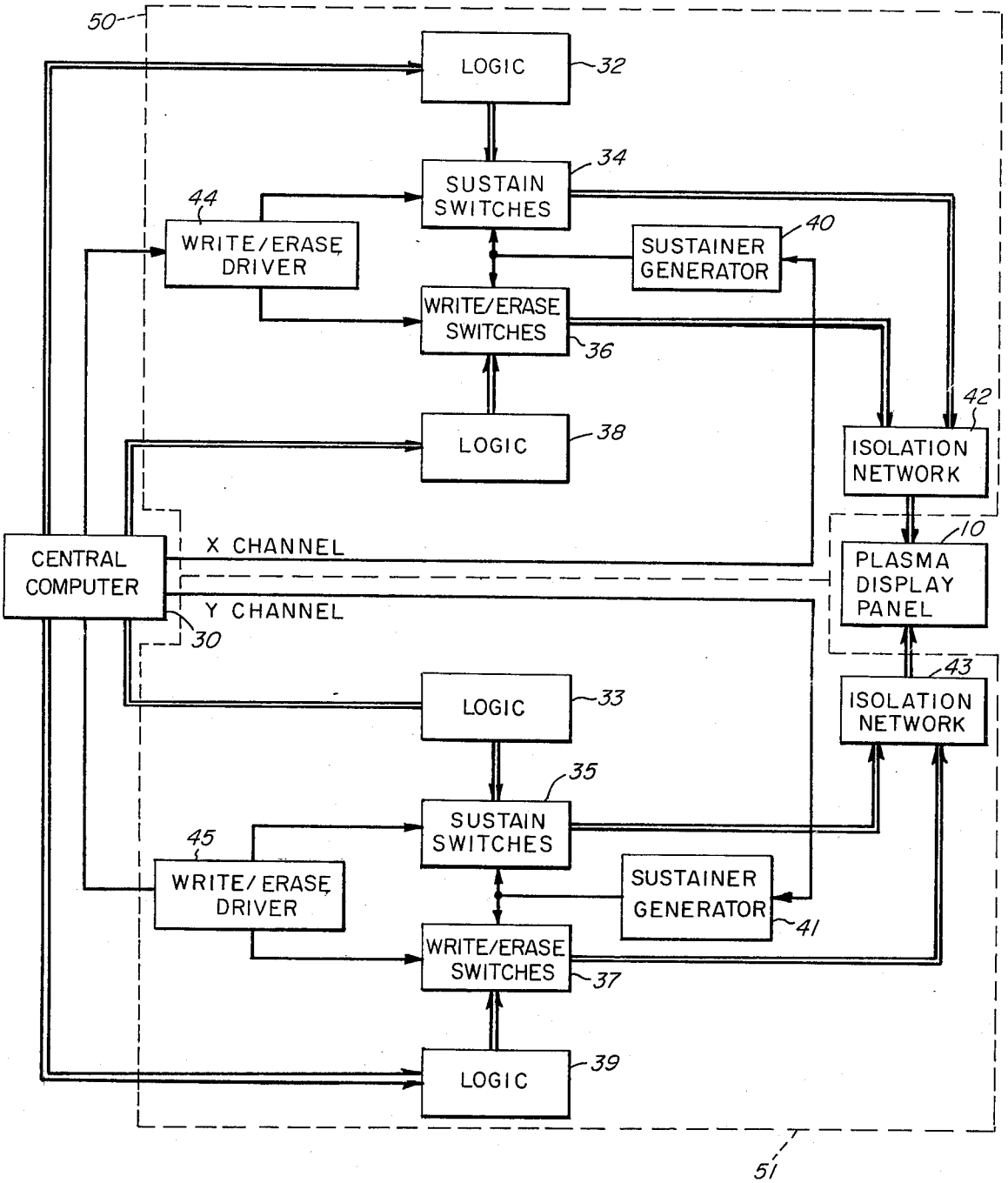
FIG. 3 is a block schematic diagram of a display system in which the present invention is used to advantage.

In FIG. 3 is shown a block schematic diagram of a display system using the present invention. The patterns to be displayed including therein alphanumeric characters and vectors are stored in the memory of central computer 30. Central computer 30 produces the signals for sequentially addressing the matrix points of plasma display panel 10 through X and Y channel drive circuitry 50 and 51 respectively. To write upon or energize light emission from matrix point of plasma panel 10, signals are coupled from central computer 30 to write/erase drivers 44 and 45 and logic circuits 38 and 39 to cause the voltage produced by write/erase drivers 44 and 45 to be coupled through write/erase switches 36 and 37 through isolation networks 42 and 43 to the appropriate drive lines of plasma display panel 10. After the desired matrix points have been energized, write/erase switches 36 and 37 remove the writing voltage from isolation networks 42 and 43. Central computer 30 acting through logic networks 32 and 33 causes the sustain voltage produced by sustainer generators 40 and 41 to be coupled through sustain switches 34 and 35 to be coupled through isolation networks 42 and 43 to the appropriate drive lines of plasma panel 10. Erasure is accomplished in the same manner as the writing operation only a voltage appropriate for erasure is applied rather than one for writing. Further details of the circuitry shown in FIG. 3 are described in the reference patent.

Although preferred embodiments of the invention have been described, numerous modifications and alternations thereto would be apparent to one having ordinary skill in the art without departing from the spirit and scope of the present invention.

What is claimed is:

1. A plasma panel display device comprising in combination:

first and second transparent plates;

first and second sets of conductive electrodes, said first and second sets of electrodes being disposed on said first and second transparent plates respectively; and a plurality of means for encapsulating a plasma forming gas, said encapsulating means being disposed between said transparent plates, said first and second sets of electrodes being adjacent to said encapsulating means, and each of said encapsulating means comprising a substantially spheroidal glass shell having a diameter in the range of 10 to 200 microns, the spacing between adjacent portions of said first and second sets of electrodes being determined by the diameter of said spheres.

2. The combination of claim 1 wherein said first and second sets of electrodes each comprise a plurality of parallel substantially transparent conductors.

3. The combination of claim 2 wherein conductors of said first set of electrodes and conductors of said second set of electrodes are substantially perpendicular to one another.

4. The combination of claim 3 wherein different portions of said plurality of encapsulating means contain therein different plasma forming gases.

5. The combination of claim 4 wherein said different portions of said plurality of said encapsulating means are arranged in a substantially linear repetitive pattern parallel to conductors of one of said first and second sets of electrodes.

6. The combination of claim 1 wherein the diameters of said spheroidal glass shells are substantially the same.

7. A plasma panel display device comprising in combination:

first and second substantially transparent plates;

a first set of parallel transparent electrodes arrayed upon a surface of said first plate;

a second set of parallel transparent electrodes arrayed upon a surface of said second plate;

a plurality of self-enclosed glass encapsulating means, each of said encapsulating means comprising a substantially spheroidal glass shell having a diameter in the range of 10 to 200 microns, said encapsulating means containing one or more plasma forming gases, said encapsulating means being deployed in a random arrangement and in a single layer between said first and second plates, said surfaces of said first and second plates being in contact with outer surfaces of said encapsulating means such that the spacing between adjacent portions of said first and second sets of electrodes is determined by the diameter of said spheres; and a plurality of connecting leads, one of said leads being connected to each one of said first and second sets of electrodes.

8. The combination of claim 7 wherein said first and second substantially transparent plates are formed of flexible plastic.

9. The combination of claim 7 further comprising:

a source of writing voltage;

a source of sustaining voltage;

a source of erasing voltage; and means for selectively coupling said writing, sustaining, and erasing voltage sources to said connecting leads.

10. The combination of claim 9 further comprising means for controlling to which of said connecting leads said writing, sustaining, and erasing signals are coupled.

* * * * *